US007850899B2

(12) United States Patent
Kunze

(10) Patent No.: US 7,850,899 B2
(45) Date of Patent: Dec. 14, 2010

(54) METHOD OF MAKING SPUN-BOND WEB FROM MULTICOMPONENT FILAMENTS

(75) Inventor: Bernd Kunze, Hennef (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 889 days.

(21) Appl. No.: 11/705,807

(22) Filed: Feb. 13, 2007

(65) Prior Publication Data

US 2007/0182057 A1 Aug. 9, 2007

Related U.S. Application Data

(63) Continuation-in-part of application No. 10/636,484, filed on Aug. 7, 2003, now abandoned.

(30) Foreign Application Priority Data

Aug. 9, 2002 (EP) ..... 02017894

(51) Int. Cl.

| | |
|---|---|
| ***D01D 5/092*** | (2006.01) |
| ***D01D 5/098*** | (2006.01) |
| ***D01D 5/22*** | (2006.01) |
| ***D01D 5/32*** | (2006.01) |
| ***D04H 3/16*** | (2006.01) |

(52) U.S. Cl. ..... 264/555; 28/104; 156/167; 156/181; 156/183; 264/103; 264/168; 264/172.14; 264/210.8; 264/211.14; 264/211.2

(58) Field of Classification Search ..... 264/103, 264/168, 172.14, 210.8, 211.14, 211.2, 555; 156/167, 181, 183; 28/104
See application file for complete search history.

(56) References Cited

U.S. PATENT DOCUMENTS

| | | | | |
|---|---|---|---|---|
| 3,707,746 | A * | 1/1973 | Summers | 28/104 |
| 4,025,595 | A * | 5/1977 | Mirhej | 264/103 |
| 2002/0063364 | A1 * | 5/2002 | Taylor et al. | 264/555 |
| 2002/0074697 | A1 * | 6/2002 | Steinke et al. | 264/103 X |

FOREIGN PATENT DOCUMENTS

WO WO 0020178 A1 * 4/2000

* cited by examiner

*Primary Examiner*—Leo B Tentoni
(74) *Attorney, Agent, or Firm*—Andrew Wilford

(57) ABSTRACT

A web is made by first extruding multicomponent filaments from a spinneret and then passing the extruded filaments through a process air shaft. Cold air is directed against the filaments in the process air shaft to cool and aerodynamically stretch the filaments while excluding the entry of other air into the process air shaft. The cooled and stretched multicomponent filaments are then deposited in a mat on a support, and then the mat of multicomponent filaments to a web is consolidated by subjecting it to water jets at a pressure of 10 bar to 200 bar such that the multicomponent filaments fuse together at crossover points and the filaments have a considerable free length between crossover points where they are fused. Finally the web is heat treated to crinkle the filaments thereof and bulk of the web.

13 Claims, 2 Drawing Sheets

METHOD OF MAKING SPUN-BOND WEB FROM MULTICOMPONENT FILAMENTS

CROSS-REFERENCE TO RELATED APPLICATIONS

This application is a continuation-in-part application Ser. No. 10/636,484 filed 07 Aug. 2003 with a claim to the priority of European application 02 017 894.3 filed 09 August, 2002.

FIELD OF THE INVENTION

The present invention relates to making a spun-bond web of multicomponent filaments and, more particularly, to a method of and apparatus for making a filament web with increased filament bulk.

BACKGROUND OF THE INVENTION

When reference is made to multicomponent filaments here, I mean filaments that are composed of a plurality of different thermoplastic synthetic resin components and especially components with different properties like thermal coefficient of expansion, heat-induced shrinkage and the like. These components can be of the same synthetic resin, for example, polyesters of different compositions or polyethylenes or polypropylenes of different properties, or components of different synthetic resins, like, for example, a polypropylene component and a polyethylene component. A reference to a bicomponent filament is intended to mean a filament that has only two different thermoplastic synthetic resins.

A cross section through such filaments will show the two components, usually in a side-by-side relationship and the separation between the two synthetic resins generally will extend over the entire length of the filament.

Spun bond here is intended to mean webs that are formed from continuous filaments as well as webs that may be formed from less than continuous filaments, i.e. filaments that may have various lengths and need not be continuous.

In the usual production of spun bond, i.e. webs formed from mats of such continuous or semicontinuous filaments, the mats or fleeces have the filaments thereof bonded together at cross-over points. One of the properties that is generally of importance in such webs is the bulk of the filaments. The bulkiness property in some cases leaves much to be desired.

In general, the filaments are extruded from a spinneret, are stretched, generally by entrainment with air, and are collected on a foraminous surface on which the mat is formed and on which the filaments are bonded at their crossing points.

In conventional spun-bond processes, the bulkiness may not be sufficient, the mechanical properties of the web may not be satisfactory and neither may be fully reproducible. As a consequence, in earlier processes, there may be an excessive reject rate.

OBJECTS OF THE INVENTION

It is the principal object of the present invention to provide an improved method of making a reproducible filament web with a high degree of bulkiness and surprisingly effective mechanical properties.

Another object of the invention is to provide a method of making a filament web of high bulk, good mechanical properties and a high degree of reproducibility without drawbacks of prior art systems.

SUMMARY OF THE INVENTION

A method of making a filament web has according to the invention the steps of first extruding multicomponent filaments consisting of at least two synthetic-resin components from a spinneret and then passing the extruded filaments through a process air shaft. Cold air is directed against the filaments in the process air shaft to cool the filaments, and the cooled filaments are aerodynamically stretched the process air shaft, while excluding the entry of other air into the process air shaft. The cooled and stretched multicomponent filaments are then deposited in a mat on a support, and then the mat of multicomponent filaments to a web is consolidated by subjecting it to water jets at a pressure of 10 bar to 200 bar such that the multicomponent filaments fuse together at crossover points and the filaments have a considerable free length between crossover points where they are fused. Finally the web is heat treated to crinkle the filaments thereof and bulk of the web.

According to a further feature of this invention the process air shaft where the freshly extruded filaments are first cooled and then stretched is closed and only cooling air is admitted into the process air shaft. In fact the same air is used both to cool and stretch the filaments. Furthermore the invention comprises the step of passing the filaments immediately after aerodynamically stretching them through a diffusor.

In accordance with the invention the jets are at a pressure of 40 bar to 130 bar, preferably 50 bar to 120 bar, more preferably 60 bar to 110 bar, and most preferably 70 bar to 110 bar.

The jets in accordance with the invention have a diameter of 0.08 mm to 0.3 mm, preferably 0.1 to 0.28 mm, more preferably 0.17 mm to 0.27 mm, and most preferably 0.14 to 0.25 mm.

The jets in accordance with the invention are spaced apart by between 20 mm and 0.6 mm, preferably 10 mm to 0.6 mm, more preferably 6 mm and 1 mm, and most preferably 5 mm and 1.6 mm.

The free length between crossover points in accordance with the invention are between 25 mm and 0.8 mm, preferably between 15 mm and 0.8 mm long, more preferably between 8.4 mm to 1.4 mm, and most preferably 7 mm and 2.2 mm long.

The filaments in accordance with the invention have a titer between 2 denier and 8 denier, preferably between 3 denier and 7 denier, and most preferably between 4 and 6 denier.

In the method of this invention the heat treating of the web entails blowing hot air against the web. As previously noted, the term "filament" is here used to refer to endless filaments of thermoplastic synthetic resins as are commonly employed for spun bond although it can encompass, as far as the present invention is concerned, also shorter filaments and fibers that can benefit from being bonded in the web by the application of the water jets and crimped or crinkled by the heat treatment.

I have found that the invention is especially effective when bicomponent filaments are used. The bicomponent filaments are comprised of only two different thermoplastic synthetic resins with different characteristics and especially different thermal expansion coefficients, different shrinkage properties and/or different mechanical or chemical properties in addition to the shrinkage and expansion.

The most highly preferred filaments are those that have two or more synthetic resin components in a side-by-side structure, i.e. the two components run next to one another to the full length of the filament. This applies especially to bicomponent filaments with a side-by-side structure. Along the length of the filament, a portion of the surface thereof is formed by the first polymer and the remainder by a second polymer in such bicomponent filaments. The use of the bicomponent filaments in a side-by-side structure has been found to eliminate completely problems with earlier low-bulk webs and to provide surprising advantages with respect to high bulk webs.

The bicomponent filaments and, generally, multicomponent filaments are produced by the individual extrusion nozzle of a spinneret adapted to handle two or more synthetic resin components. The extruded filament are cooled, e.g. by contact with process air in the process air shaft and can be stretched as they move downward along this shaft. The foraminous surface can be a perforated conveyor belt, i.e. a sieve belt that can be evacuated below the surface.

The water jet stabilization of the mat to produce the web can employ a multiplicity of fine very high speed water jets directed uniformly over the entire mat surface. The water jets press the overlying filaments against underlying filaments to effect fusion between the filaments at the cross-over points.

Following the water jet treatment, the web is activated by a heat treatment and especially a heating in hot air at a temperature above 60° C. Because of different shrinkage and/or expansion characteristics of the polymers in the filaments, a crinkling or crimping is produced that bulks the web. Indeed, the web that results in accordance with the invention has especially high bulk and optimal mechanical characteristics that appear to derive from the combination of water jet stabilization and subsequent heat treatment. In fact, without multicomponent and especially bicomponent filaments and both the water jet stabilization and heat treatment activation, an equivalent high bulk mechanically satisfactory web is not obtainable.

It has been found, for example, that the invention provides a web with especially long free filament segments, i.e. a high free filament length, in terms of the average length of filaments between two bonding or contact sizes with filaments at crossovers. The high prefilament length means that the crimp, curling and in general bulking that is formed by the crinkling step, allows the development of a large number of loops, bends and other formations that extend transversely to the web and account for the bulk thereof. In addition, the bulking is especially reproducible.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
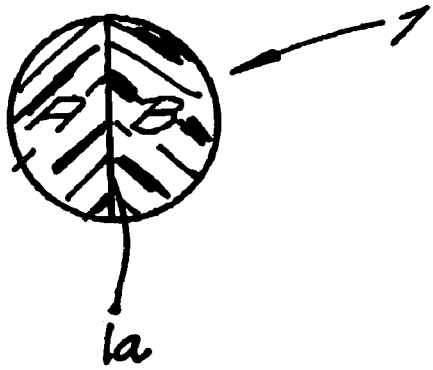
FIG. 1 is a diagrammatic cross section of a bicomponent filament in accordance with the invention.

FIG. 1 shows a cross section through a bicomponent filament in accordance with the invention and from this Figure it can be seen that the bicomponent filament comprises a polymer A making up half the cross section of the filament and a polymer B making up the other half of the cross section. The two polymers adjoin at a diametral interface la and thus are in side-by-side relationship over the length of the filament.

Of course, either one of the components A or B can make up a greater portion of the cross section than the other and can extend over a greater portion of the surface of the filaments than the other. The polymers A and B are for example two polymers that are compatible with one another and bond integrally to one another but have different heat shrinkage properties or different coefficients of thermal expansion.

Figure 2:
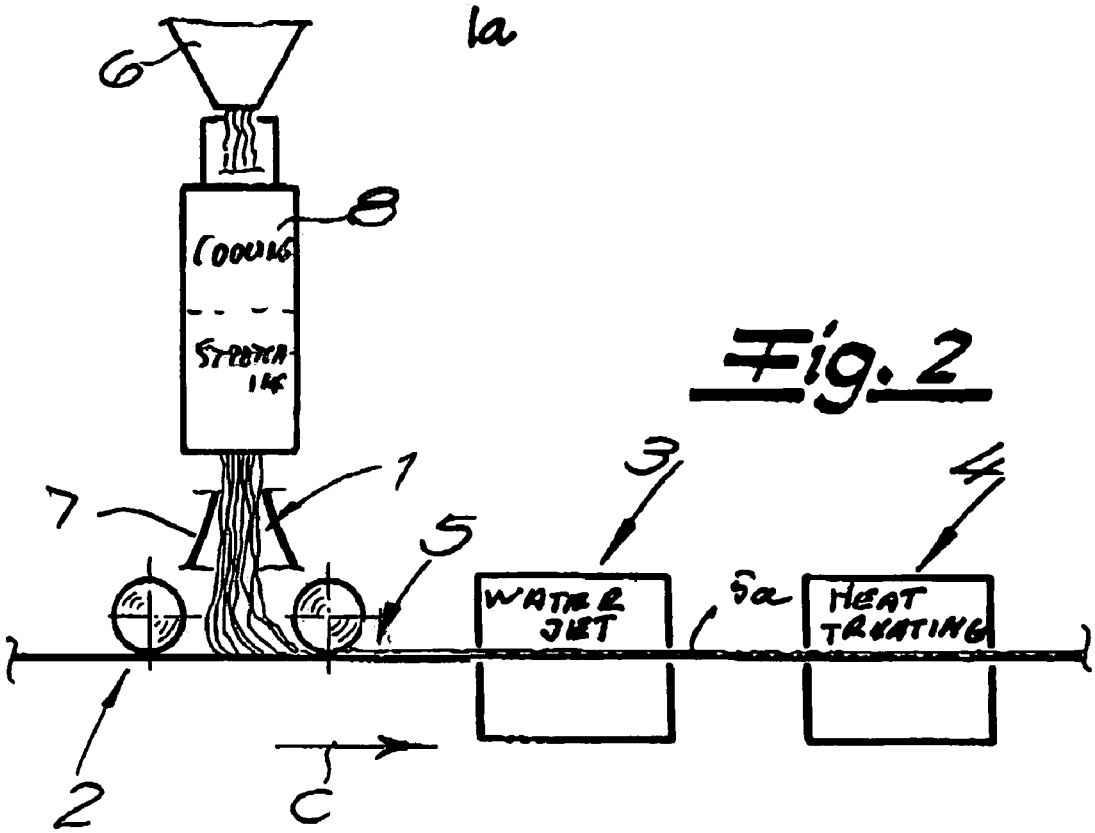
FIG. 2 is a schematic side view of the filament collection portion of the apparatus and the units downstream thereof in accordance with the invention.
Figure 3:
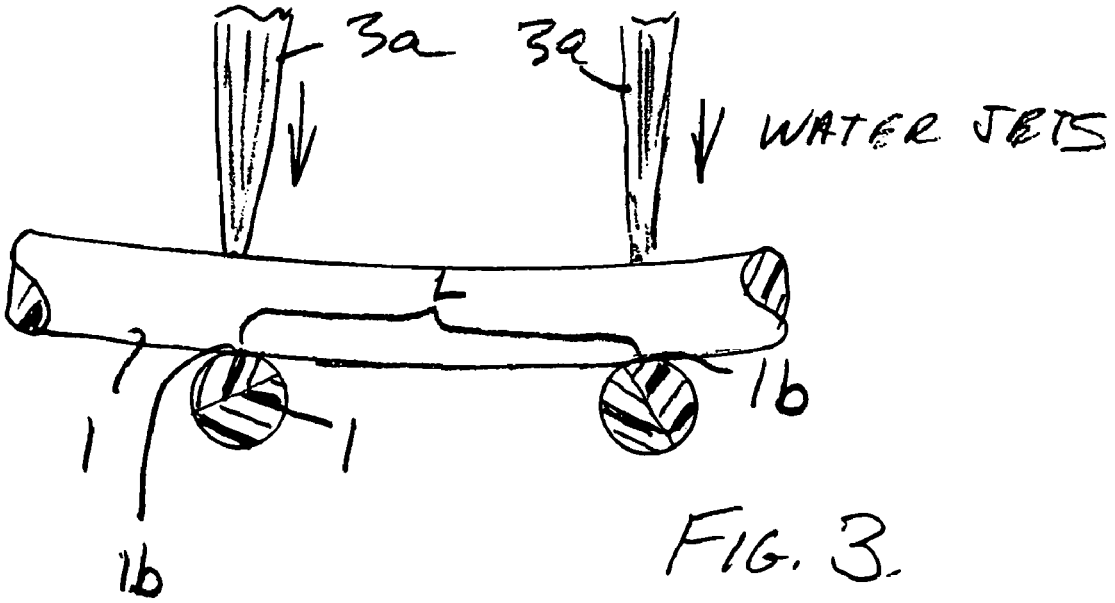
FIG. 3 is a diagram illustrating the water jet stage of the invention.

FIG. 2 shows in highly schematic fashion the formation of the spun-bond web in accordance with the invention. The filaments 1, collected from a spinneret 6 from which the bicomponent filaments are extruded and a cooling and stretching shaft 8, pass downstream of the closed shaft 8 through a diffuser 7, and gather on the endless sieve belt 2 into a mat 5 that is displaced in the direction of the arrow C. In a stabilizing station 3, the filament mat or fleece is subjected to a multiplicity of high velocity water jets as shown at 3*a* in FIG. 3, these water jets serving to bond crossing filaments 1 to one another at bonding or fusion points 1*b* where these filaments cross one another. A considerable free length L may be provided between bonding points.

The water jets can be extremely fine water jets and preferably are of very high velocity. The water jets can be directed from nozzles having a diameter of from several millimeters to a fraction of a millimeter and at a pressure ranging from 2 bar to 1000 bar.

Figure 4:
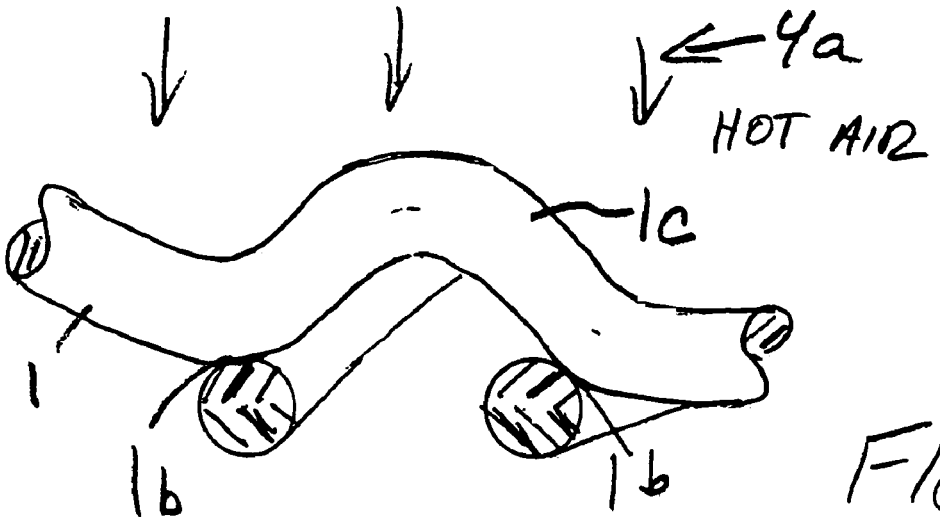
FIG. 4 is a diagram showing the hot air treatment stage.

Subsequently the bonded filaments of the mats that now form a web 5*a* pass into a heat-treating station 4 in which hot air can be directed onto the web. The hot air flow is represented at 4*a* in FIG.4 and serves to cause crinkling or crimping at 1*c* of the filaments 1 between the fusion points 1*b*. The result is a high bulk spun-bond web. The apparatus of FIG. 2 has been shown in a highly simplified manner. It will be understood that other processing elements and apparatus components may be used where required or desirable.

I claim:

1. A method of making a filament web, the method comprising the steps of:

a) extruding multicomponent filaments consisting of at least two synthetic-resin components from a spinneret with the components side-by-side;

b) passing the extruded filaments through a closed process air shaft;

c) directing cold air against the filaments in the process air shaft to cool the filaments;

d) aerodynamically stretching the cooled filaments in the process air shaft with the cold air used to cool the filaments;

e) excluding the entry of air other than the cold air into the process air shaft;

f) depositing the cooled and stretched multicomponent filaments in a mat upon a support;

g) thereafter consolidating the mat of multicomponent filaments to a web by subjecting the mat to water jets at a pressure of 10 bar to 200 bar such that the multicomponent filaments fuse together at crossover points and the filaments have a free length between crossover points where they are fused of between 25 mm and 0.8 mm; and h) subsequently heat treating the web to crinkle the filaments thereof and bulk the web.

2. The method defined in claim 1 further comprising the step of passing the filaments immediately after aerodynamically stretching them through a diffusor.

3. The method defined in claim 1 wherein the jets are at a pressure of 40 bar to 130 bar.

4. The method defined in claim 1 wherein the jets are at a pressure of 70 bar to 110 bar.

5. The method defined in claim 1 wherein the jets have a diameter of 0.08 mm to 0.3 mm.

6. The method defined in claim 1 wherein the jets have a diameter of 0.14 to 0.25 mm.

7. The method defined in claim 1 wherein the jets are spaced apart by between 20 mm and 0.6 mm.

8. The method defined in claim 1 wherein the jets are spaced apart by between 5 mm and 1.6 mm.

9. The method defined in claim 1 wherein the free lengths between crossover points are between 6 mm and 2.2 mm.

10. The method defined in claim 1 wherein the filaments are between 2 denier and 8 denier.

11. The method defined in claim 1 wherein the filaments are between 4 and 6 denier.

12. The method defined in claim 1 wherein the filaments are bicomponent filaments.

13. The method defined in claim 1 wherein the heat treating of the web in step h entails blowing hot air against the web.

* * * * *